United States Patent [19]

Kikugawa

[11] Patent Number: 5,028,157

[45] Date of Patent: Jul. 2, 1991

[54] PRINTER HAVING AN ERASING MECHANISM

[75] Inventor: Noriyuki Kikugawa, Kanagawa, Japan

[73] Assignee: Canon Kabushiki Kaisha, Tokyo, Japan

[21] Appl. No.: 384,872

[22] Filed: Jul. 21, 1989

Related U.S. Application Data

[63] Continuation of Ser. No. 149,946, Jan. 28, 1988, abandoned, which is a continuation of Ser. No. 838,395, Mar. 6, 1986, abandoned, which is a continuation of Ser. No. 577,991, Feb. 8, 1984, abandoned.

[30] Foreign Application Priority Data

Feb. 28, 1983 [JP] Japan ..... 58-33037

[51] Int. Cl.[5] ..... B41J 11/60

[52] U.S. Cl. ..... 400/696; 400/697; 400/697.1

[58] Field of Search ..... 400/696, 695, 697, 697.1, 400/144.2, 154.5

[56] References Cited

U.S. PATENT DOCUMENTS

| | | | |
|---|---|---|---|
| 3,746,958 | 7/1973 | Leenhouts | 318/696 |
| 4,153,866 | 5/1979 | Leenhouts | 318/696 |
| 4,286,889 | 9/1981 | Ebert et al. | 400/697.1 |
| 4,307,971 | 12/1981 | Kane, III et al. | 400/697 |
| 4,311,398 | 1/1982 | Gerjets | 400/697 |
| 4,361,410 | 11/1982 | Nakajima et al. | 368/157 |
| 4,388,005 | 6/1983 | Wehking et al. | 400/697 |
| 4,464,071 | 8/1984 | Sakakibara | 400/144.2 |
| 4,692,045 | 9/1987 | Makita | 400/697 |

FOREIGN PATENT DOCUMENTS

| | | | |
|---|---|---|---|
| 2301565 | 11/1973 | Fed. Rep. of Germany | 400/697 |
| 56883 | 4/1983 | Japan | 400/697.1 |
| 160180 | 9/1983 | Japan | 400/697 |
| 160181 | 9/1983 | Japan | 400/697 |
| 160182 | 9/1983 | Japan | 400/697 |

OTHER PUBLICATIONS

Elektrie, vol. 28, No. 4, pp. 191-193, (1974).

*Primary Examiner*—Edgar S. Burr
*Assistant Examiner*—Joseph R. Keating
*Attorney, Agent, or Firm*—Fitzpatrick, Cella, Harper & Scinto

[57] ABSTRACT

A printer has a mechanism for erasing a printed character by impacting a type through an erasing ribbon, and a stepping motor for rotating a type wheel to select a character. In an erasing operation, the type wheel is rotated by the stepping motor by a small rotation angle so that the type is superpositioned on the printed character.

13 Claims, 5 Drawing Sheets

PRINTER HAVING AN ERASING MECHANISM

This application is a continuation of application Ser. No. 149,946 filed Jan. 28, 1988, now abandoned, which is a continuation of application Ser. No. 838,395, filed Mar. 6, 1986, now abandoned, which is a continuation of application Ser. No. 577,991, filed Feb. 8, 1984, now abandoned.

BACKGROUND OF THE INVENTION

1. Field of the Invention

The present invention relates to a printer, and more particularly to an impact printer having a mechanism for erasing a printed character with an erasing ribbon for correction.

2. Description of the Prior Art

In a prior art typewriter, when a printed character is to be erased, a print head is moved to the character to be erased and a type corresponding to that character is impacted through an erasing ribbon in response to an erase command. The erasing ribbon is an adhesive tape or a tape having a coating material of the same color as that of a print paper applied on a back side thereof. In the former case, ink of the printed character is removed from the print paper, and in the latter case the character is overprinted, to erase the printed character.

In such a prior art printer having an overprint type erasing mechanism as shown in U. S. Pat. No. 4,307,971, the precision of movement of a lateral drive mechanism of a carriage is not high and an unerased indicia often remains due to hysteresis and vibration of the carriage drive mechanism. When a character is printed over the correction area, it is overlapped with the unerased indicia and very poor finishing is presented.

If precision of operation of the drive mechanism is to be improved in order to perfectly erase the character by the overprint erasing mechanism, the manufacturing cost of the device will remarkably increase.

SUMMARY OF THE INVENTION

It is an object of the present invention to provide a printer having an erasing mechanism which can exactly erase a printed character with a simple structure of rotating a type wheel by a small rotation angle instead of moving a carriage as is done in the above-referenced U.S. patent.

DETAILED DESCRIPTION OF THE PREFERRED EMBODIMENTS

In the following embodiments, an electronic typewriter having a daisy type wheel as a type element is utilized.

Figure 1:
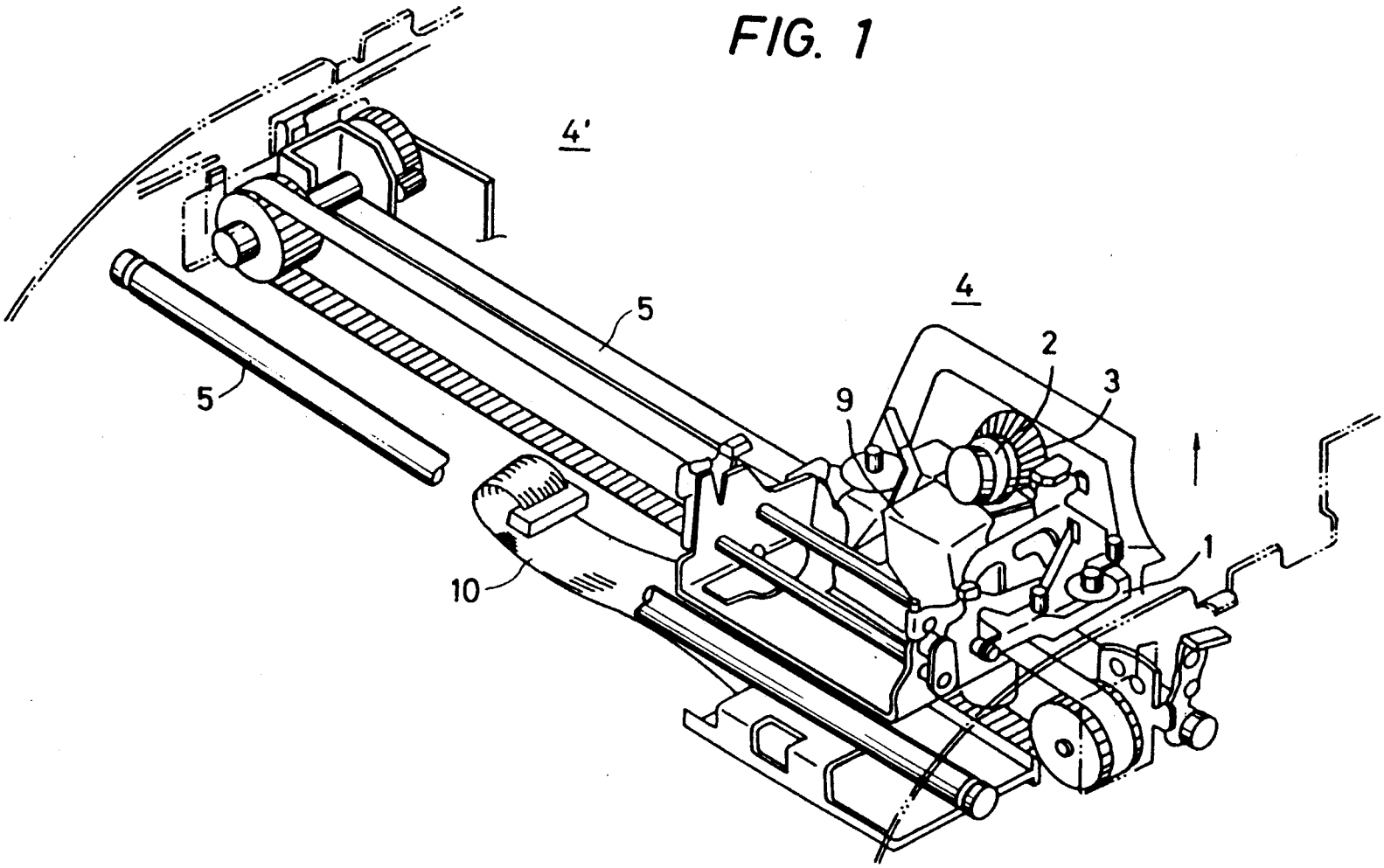
FIG. 1 is a perspective view showing a mechanical structure of one embodiment of the present invention.

FIG. 1 shows a structure of a mechanical portion of a printer of the present invention. Mounted on a carriage 4 are a type wheel 3 made of a flexible material such as plastic, and a stepping motor 9 on which a print hammer 2 is mounted. A ribbon shift mechanism 1 for positioning a print ribbon 6 and an erasing ribbon 7 between a print paper on a platen (not shown), and the type wheel 3 is provided.

Figure 2:
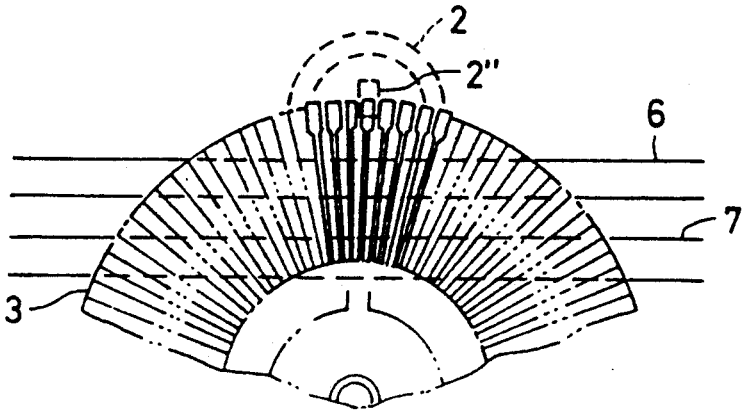
FIG. 2 shows a structure of a type wheel in one embodiment of the present invention.

FIG. 2 shows non-print positions of the type wheel 3 and the print ribbon 6 and the erasing ribbon 7. The print ribbon 6 and the erasing ribbon 7 are lifted by the ribbon shift mechanism 1 in the direction of an upward arrow in FIG. 1, in the print mode and the erasing mode, respectively, and they are interposed between the type wheel 3 and the print paper so that the printing and the erasing are effected when a type element at an end of a spoke formed on an outer periphery of the type wheel 3 is impacted by a hammer 2'' of the print hammer device 2.

A carriage 4 carrying the above mechanism is driven by a carriage drive system 4', including a belt or a pulley, along a guide bar 5 in parallel to the platen (not shown) one character pitch or a plurality of spaces at a time. In FIG. 1, numeral 9 denotes a cable and connector for supplying power supply voltages and control signals to the devices on the head carriage 4.

Figure 3:
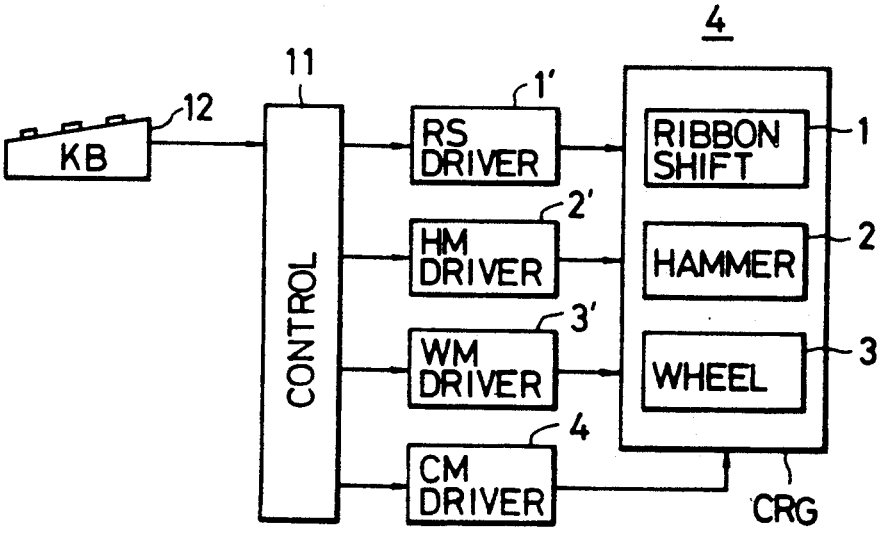
FIGS. 3 and 4 are block diagrams of one embodiment of the present invention.

An electronic circuit for controlling the mechanism of the present invention is shown in FIG. 3, in which the like elements to those shown in FIGS. 1 and 2 are designated by the like numerals.

In FIG. 3, numeral 11 denotes a control to which a keyboard (KB) 12 is connected. By depressing a key on the keyboard 12, a command is sent to the control 11 causing it to control the type wheel 3, the print hammer device 2, the ribbon shift mechanism 1 and the carriage 4 through a WM driver 3' of a type wheel driving stepping motor, a print hammer HM driver 2', a ribbon shift RS driver 1' and a CM driver 4 of a carriage driving stepping motor.

Figure 4:
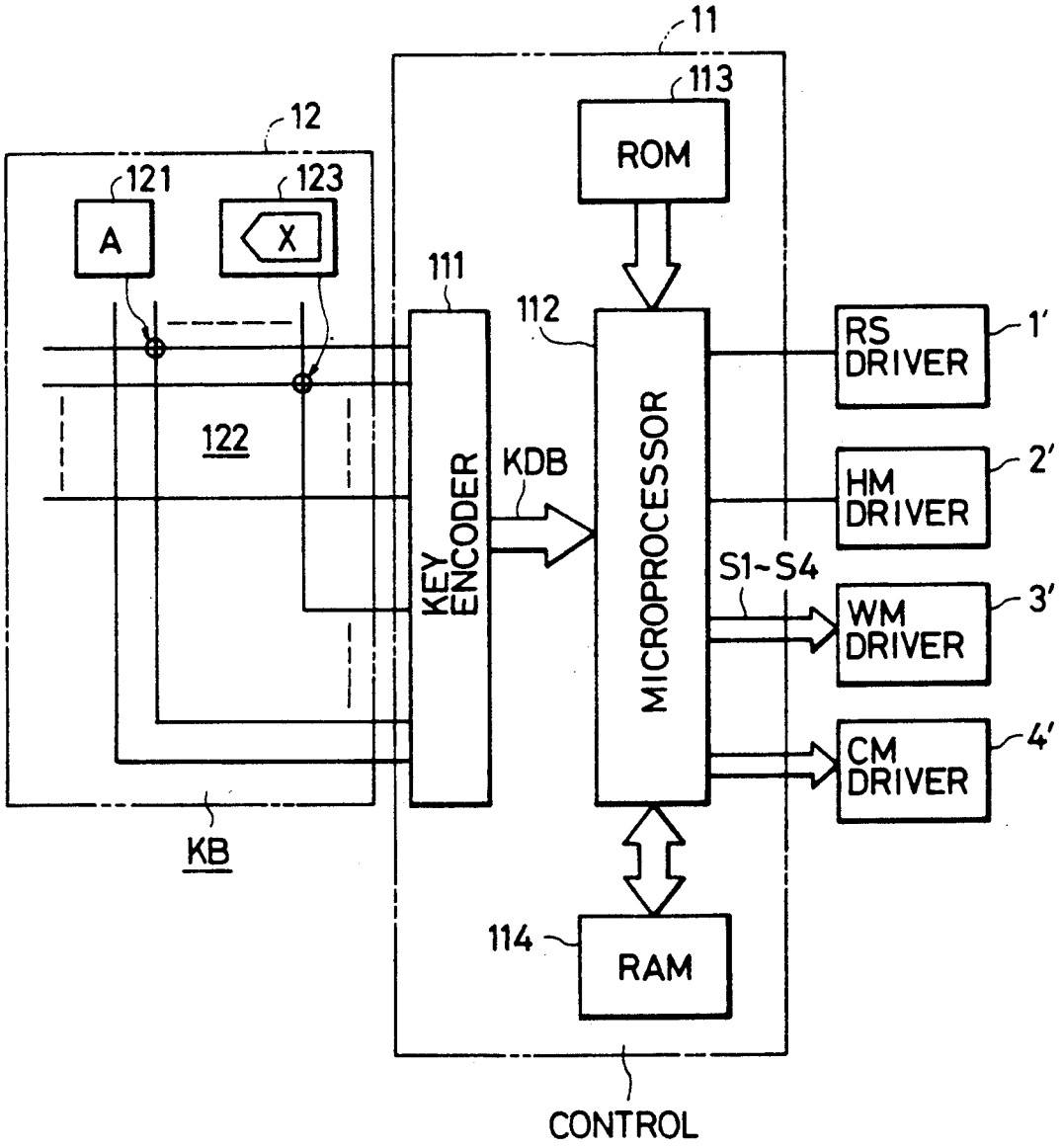

FIG. 4 shows a detail of the electronic circuit The numerals 11X denote the blocks of the control 11, the numerals 12X denote the keys and the circuits of the keyboard 12 and other like numerals to those shown in FIG. 3 denote the like elements.

In FIG. 4, numerals 121 and 123 denote the keys arranged on the keyboard (KB) 12, the numeral 121 specifically denotes a character key for printing a character (for example, a character "A") and the numeral 123 specifically denotes an erasing key for specifying the erasure of a printed character.

The depression of the character key 121 or the erasing key 123 is detected by a key matrix 122 to which a key encoder (KE) 111 is connected. The key encoder 111 is connected to microprocessor 112 through a data bus KDB.

The microprocessor 112 comprises a processor for processing information, registers for storing numeric data, an adder for carrying out an arithmetic operation and a controller, as well as an external ROM for storing microinstruction information for serial control and an external RAM which is used as a line buffer and a working memory.

The microprocessor 112 also has output ports through which signals are supplied to the RS driver 1', the HM driver 2', the WM driver 3' and the CM driver 4'.

Figure 5:
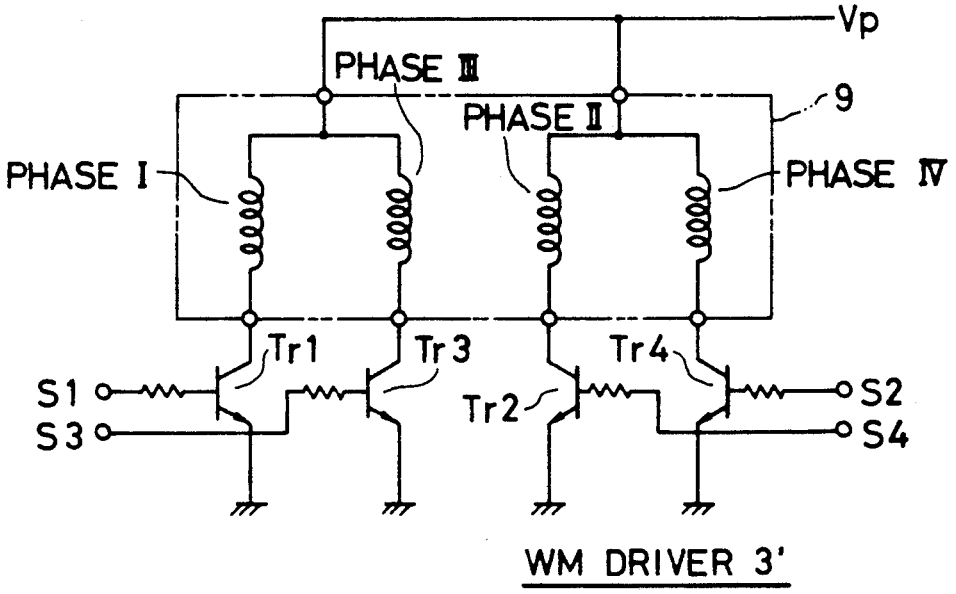
FIG. 5 shows a circuit diagram of a portion of one embodiment of the present invention.

FIG. 5 shows a detail of the WM driver 3'. Numeral 9 denotes a 4-phase unipolar winding stepping motor for driving the type wheel. Terminals S1–S4 are connected to the output ports of the microprocessor 112.

Transistors Tr1–Tr4 are rendered conductive by the signals applied to the terminals S1–S4, respectively so that the respective phases I–IV are driven. In the print operation, the type wheel is held while one of the phases I–IV is driven (one-phase drive), and the hammer device is driven. Thus, each of the phases I–IV of the stepping motor corresponds to one of the type elements. (For example, "A" corresponds to the phase I.)

Figure 6A:
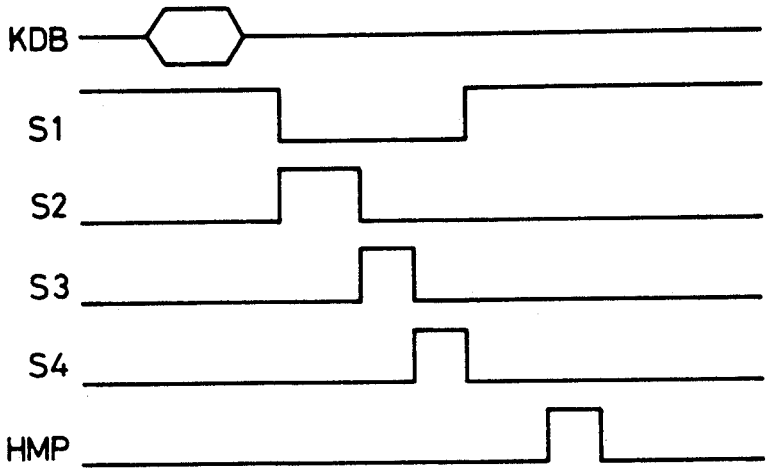
FIGS. 6A, 6B and 6C are timing charts showing control steps for an electronic control circuit of the present invention.

The procedure of the normal print operation is explained below with reference to a timing chart of FIG. 6A.

In the normal print operation, the character key (for example, "A") on the keyboard 12 is depressed. The position of the depressed character key 121 is detected by the key matrix 122 and the detector signal is converted to an electrical information signal by the key encoder 111. The signal is then supplied to the microprocessor 112 through the data bus KDB. The microprocessor 112 calculates a direction of rotation and a rotation angle (the number of steps of the stepping motor 9) of the type wheel 3 to reach the selected character "A" from the current position of the type wheel 3 (for example, a character "B" facing the hammer 2''). Assuming that the character "B" corresponds to the phase I of the stepping motor 9 and the character "A" corresponds to the phase I which is four steps away from that of the character "B", the microprocessor 112 produces a velocity profile required to drive the motor 9 by four steps, by referring the ROM 113 and supplied the corresponding signals to the output ports S1–S4. The transistors Tr1–Tr4 are rendered conductive in accordance with the signals at the output ports S1–S4 and the phases I–IV are driven so that the character "A" is selected.

After the character has been selected, the microprocessor 112 drives the hammer driver 2' in accordance with the impression information for the selected character and causes the print hammer device 2 to impact the type element with an impression force determined by the selected character. The output signal of the print hammer driver 2' is shown by the signal HM DRIVER in FIG. 6B.

In this manner, the normal print operation of depression of the character key→character selection→impression is carried out.

Figure 6B:
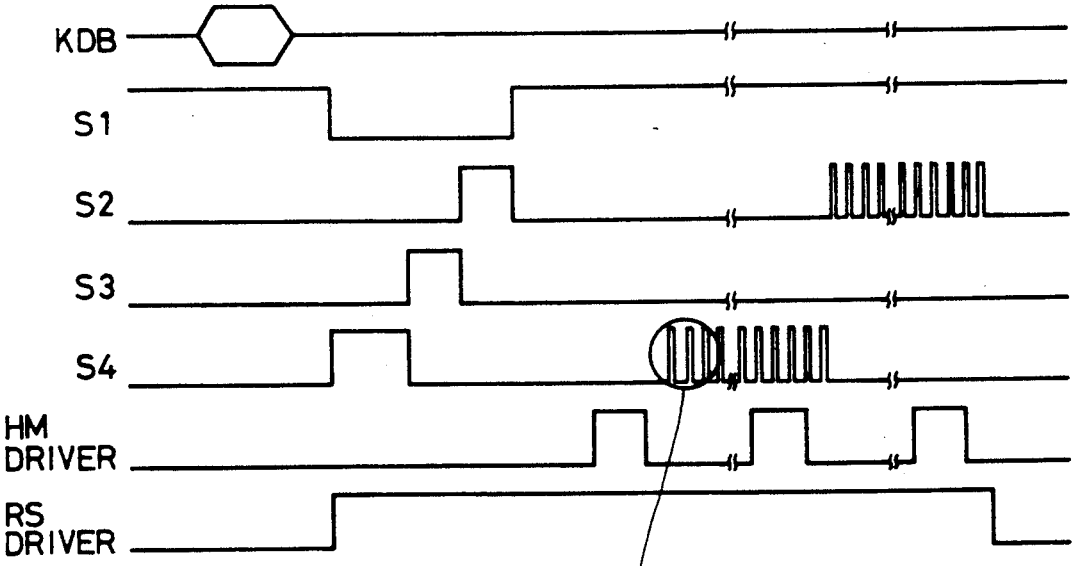

The procedure of erasing operation for the printed character will be now explained with reference to a timing chart of FIG. 6B.

To erase the printed character, the carriage 4 is moved to the printed character to be erased by depressing a backspace key or a space key arranged on the keyboard 12.

Then, the erasing key 123 is depressed to start the erasing operation. The depression of the erasing key 123 is transmitted from the key matrix 122 to the microprocessor 112 through the key encoder 111, as is done in the print operation.

When the microprocessor 112 receives the erasing command, it refers to the line buffer (RAM) 114 to determine the positions of the printed character to be erased (for example "B") and the current position of the type wheel 3 (for example "A" facing the hammer 2'') and selects the character "B" (brings the character "B" to face the hammer 2'') as it does in the print operation.

The microprocessor 112 causes the wheel driving stepping motor 9 to rotate and drives the ribbon shift driver 1'. Thus, the erasing ribbon 7 is lifted by the ribbon shift mechanism 1 in the direction of the arrow shown in FIG. 1. The output signal of the ribbon shift driver 1' is shown by RS DRIVER in FIG. 6B.

The microprocessor 112 thus causes the print hammer device 2 to effect a first impression through the lifted erasing ribbon.

Figure 6C:
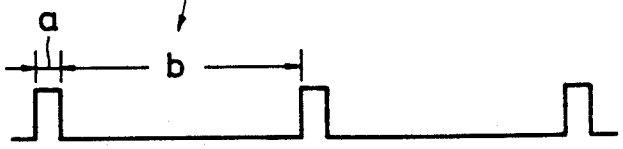

Then, the microprocessor 112 causes the type wheel 3 to rotate by a predetermined small angle and causes the print hammer device 2 to effect a second impression. A problem that may arise here is that the type wheel driving stepping motor 9 may not have a resolving power precise to effect such a small angle of rotation but usually has as much or twice as much, at most, resolving power as the number of type elements of the type wheel 3. Thus, as shown in FIG. 6B, the phase (IV, or it may be the phase II) adjacent to the stable phase (phase I) is repeatedly driven for a short time to rotate the type wheel 3 by the small angle. The small angle can be adjusted by varying times a and b shown in FIG. 6C. When the repetitive drive is ceased, the type wheel is returned to the original position because the signal S1 is held.

The microprocessor 112 then causes the type wheel 3 to rotate reversely to the previous rotation (by repetitively driving the phase (phase II) opposite to the previous phase for a short time and causes the hammer device 2 to effect a third impression.

In this manner, the erasing operation of the depression of the erasing key, the selection of the character, the impression, the small angle of rotation of the type wheel, the impression the small angle of rotation of the type wheel in the reverse direction and the impression is carried out. The erasing ribbon 7 is kept shifted throughout a series of erasing operations, as described above.

In the above embodiment, the type wheel is rotated by the small angle by repetitively driving the phase adjacent to the stable phase of the type wheel driving stepping motor for a short time. The same effect will be attained by continuously driving the adjacent phase by a small current.

For a two-phase excitation system, one of the two driven phases may be repetitively deactivated for a short time or the drive currents may be unbalanced to rotate the type wheel by the small angle.

While the 4-phase unipolar winding stepping motor is used to drive the type wheel in the above embodiment, a motor other than the 4-phase motor, for example, a bipolar winding motor may be used.

In accordance with the present invention, the following advantage is attained.

In erasing the printed character, the impression is first made through the erasing ribbon and then the type wheel is rotated to the opposite sides of the character to be erased and the impression is made twice through the erasing ribbon. Accordingly, a printer which can correct a character with excellent finishing and at low cost is provided.

What I claim is:

1. Printing apparatus for printing on a paper, comprising:

a type unit provided with a plurality of type elements spatially arranged in a predetermined type element pitch;

a pulse motor mechanically coupled to said type unit and having a plurality of energizing phases, the rotation step between two neighboring energizing phases, in the pulse motor corresponding to said type element pitch;

drive means for sequentially energizing each of the energizing phases of said pulse motor with a pulse lasting a predetermined time period to place a selected type element in a print position;

an erase ribbon; and erasing means for selecting an erasing mode for erasing a printed indicia on the paper by striking said erase ribbon with a type element of the printed indicia, wherein, said drive means comprises, in response to selection of the erasing mode:

means for energizing a first energizing phase of said pulse motor with the pulse lasting said predetermined time period so that a type element of the printed indicia strikes the indicia printed on the paper to be erased through said erase ribbon at a first central position;

means for repeatedly energizing with plural pulses each lasting a time period short with respect to said predetermined time period a second energizing phase neighboring the first energizing phase, under the condition in which energization of the first energizing phase is maintained, so that a type element of the printed indicia strikes the indicia printed on the paper through said erase ribbon at a second position which is slightly shifted from the first central position; and means for repeatedly energizing with plural pulses each lasting a time period short with respect to said first predetermined time period a third energizing phase opposite to the second energizing phase, under the condition in which energization of the first energizing phase is maintained, so that a type element of the printed indicia strikes the indicia printed on the paper through said erase ribbon at a third position which is slightly shifted from the first central position in a direction opposite to the direction in which the second position is shifted from the first central position.

2. Printing apparatus according to claim 1, wherein at least one of said second and third energizing phases is energized with a sequence of pulses.

3. Printing apparatus according to claim 2, wherein the positions of the second and third positions are controlled by adjusting the duty ratio of the pulses.

4. Printing apparatus according to claim 1, wherein said erase ribbon is advanced for every striking.

5. Printing apparatus according to claim 1, wherein at least one of said second and third energizing phases is energized with a low level current.

6. Printing apparatus for printing on a paper, comprising:

a type unit provided with a set of type elements spatially arranged in a predetermined type element pitch;

a first driver for actuating one of the type elements to print an indicia on a paper;

a pulse motor mechanically coupled to said type unit for rotating said type element set to place a selected type element to a print position, said pulse motor having a plurality of energizing phases and the elemental rotation step between two neighboring energizing phases corresponding to said type element pitch;

a second driver for sequentially energizing each of the energizing phases of said pulse motor by a pulse lasting a predetermined time period to rotate said pulse motor by said one elemental rotation step;

an erase ribbon;

an eraser for generating an erase instruction for erasing a printed indicia on the paper by striking said erase ribbon with a type element of the printed indicia; and a controller, operative in response to an erase instruction, for controlling said second driver such that said second driver comprises:

means for energizing a first energizing phase of said pulse motor with the pulse lasting said predetermined time period so that a type element of the printed indicia strikes the indicia printed on the paper through said erase ribbon at a first central position;

means for repeatedly energizing with plural pulses each lasting a time period short with respect to said predetermined time period a second energizing phase neighboring the first energizing phase, under the condition in which energization of the first energizing phase is maintained, so that a type element of the printed indicia strikes the indicia printed on the paper through said erase ribbon at a second position which is slightly shifted from the first central position; and means for repeatedly energizing with plural pulses each lasting a time period short with respect to said predetermined time period a third energizing phase opposite to second energizing phase, under the condition in which energization of the first energizing phase is maintained, so that a type element of the printed indicia strikes the indicia printed on the paper through said erase ribbon at a third position which is slightly shifted from the first central position in a direction opposite to direction in which the second position is shifted from the first central position.

7. Printing apparatus according to claim 6, wherein said first energizing signal is DC signal and at least one of said second and third energizing phases is energized with a sequence of pulses.

8. Printing apparatus according to claim 7, wherein when slightly shifting the erasing type element, said second driver energizes said second and third energizing phases with the sequence of pulses and simultaneously energizes the energizing phase corresponding to the erasing type element with the DC signal.

9. Printing apparatus according to claim 7, wherein the positions of the second and third positions are controlled by adjusting the duty ratio of the pulses.

10. Printing apparatus according to claim 6, wherein said set of type elements is in a daisy wheel arrangement.

11. Printing apparatus for printing on a paper, comprising:

a type unit provided with a plurality of type elements spatially arranged in a predetermined type element pitch;

a pulse motor mechanically coupled to said type unit and having a plurality of energizing phases, the rotation step between two neighboring energizing phases in the pulse motor corresponding to said type element pitch;

a printing ribbon; and drive means for energizing a first energizing phase of said pulse motor with a pulse lasting a predetermined time period so that a type element of the printed indicia strikes the indicia printed on the paper through said printing ribbon at a first central position;

means for repeatedly energizing with plural pulses each lasting a time period short with respect to said predetermined time period a second energizing phase neighboring the first energizing phase, under the condition in which energization of the first energizing phase is maintained, so that a type element of the printed indicia strikes the indicia printed on the paper through said printing ribbon at a second position which is slightly shifted from the first central position; and means for repeatedly energizing with plural pulses each lasting a time period short with respect to said predetermined time period a third energizing phase opposite to the second energizing phase, under the condition in which energization of the first energizing phase is maintained, so that a type element of the printed indicia strikes the indicia printed on the paper through said printing ribbon at a third position which is slightly shifted from the central first position in a direction opposite to the direction in which the second position is shifted from the first central position.

12. Printing apparatus according to claim 11, wherein at least one of the energizing phases is energized with a sequence of pulses.

13. Printing apparatus according to claim 12, wherein the positions of the second and third positions are controlled by adjusting the duty ratio of the pulses.

* * * * *

UNITED STATES PATENT AND TRADEMARK OFFICE

CERTIFICATE OF CORRECTION

PATENT NO. : 5,028,157

DATED : July 2, 1991

INVENTOR(S) : Noriyuki Kikugawa

It is certified that error appears in the above-identified patent and that said Letters Patent is hereby corrected as shown below:

COLUMN 2

Line 43, "the" should be deleted.

COLUMN 3

Line 29, "supplied" should read --supplies--.

COLUMN 4

Line 67, "phases," should read --phases--.

COLUMN 6

Line 29, "to second" should read --to the second--.
Line 35, "to direction" should read --to the direction--.

Signed and Sealed this

Ninth Day of March, 1993

*Attest:*

STEPHEN G. KUNIN

*Attesting Officer*

*Acting Commissioner of Patents and Trademarks*